US006745415B1

(12) United States Patent
Brettell

(10) Patent No.: US 6,745,415 B1
(45) Date of Patent: Jun. 8, 2004

(54) SPLASH BLOCK FOR COMBINATION BATHTUB/SHOWER STRUCTURES ENCLOSED BY SHOWER CURTAIN ASSEMBLIES

(76) Inventor: Scott Brettell, 13 Dundalk Court, St. Catharines Ontario (CA), L2M 3M7

( * ) Notice: Subject to any disclaimer, the term of this patent is extended or adjusted under 35 U.S.C. 154(b) by 0 days.

(21) Appl. No.: 10/388,434

(22) Filed: Mar. 17, 2003

(51) Int. Cl.[7] ..... A47K 3/20
(52) U.S. Cl. ..... 4/609
(58) Field of Search ..... 4/608, 609; D23/307

(56) References Cited

U.S. PATENT DOCUMENTS

| | | | | |
|---|---|---|---|---|
| 1,807,107 | A | | 5/1931 | Sternbergh |
| 3,737,921 | A | | 6/1973 | Baumrind |
| 3,984,880 | A | | 10/1976 | Schrameyer |
| D253,188 | S | * | 10/1979 | Baugus ..... D23/307 |
| D271,516 | S | | 11/1983 | Dose et al. |
| 4,473,911 | A | | 10/1984 | Germain |
| D284,024 | S | | 5/1986 | Olson |
| 5,222,261 | A | | 6/1993 | Tooze et al. |
| 5,274,859 | A | | 1/1994 | Redman et al. |
| D396,273 | S | * | 7/1998 | Delawder ..... D23/307 |
| 5,978,985 | A | | 11/1999 | Thurman |
| 5,996,141 | A | * | 12/1999 | Ibrahim ..... 4/609 |
| 6,035,461 | A | | 3/2000 | Nguyen |
| 2002/0166165 | A1 | | 11/2002 | Logan |

* cited by examiner

*Primary Examiner*—Robert M. Fetsuga
(74) *Attorney, Agent, or Firm*—Patrick J. Hofbauer

(57) ABSTRACT

Disclosed is a splash block for use with a combination bathtub/shower structure of the type having a substantially planar, horizontal rim surface extending underneath a shower curtain rod. The splash block comprises a ramp portion and a collar portion, wherein the ramp portion has a drainage surface bounded by a peripheral edge consisting of a drip edge and a collar-receiving edge, and wherein the collar portion extends around the collar-receiving edge, and is positionable at an operative position on said rim surface whereat said ramp portion substantially overlies one of said exposed contiguous corners with the drip edge presenting towards the bathing recess, with the drainage surface of said ramp portion presenting upwardly and sloping downwardly to the drip edge, and with the collar portion projecting upwardly.

10 Claims, 5 Drawing Sheets

SPLASH BLOCK FOR COMBINATION BATHTUB/SHOWER STRUCTURES ENCLOSED BY SHOWER CURTAIN ASSEMBLIES

FIELD OF THE INVENTION

The present invention relates to the field of shower curtain leak protection apparatus.

BACKGROUND OF THE INVENTION

It is common practise to provide a combination bathtub/shower structure of the alcove type in residential dwellings.

Such structures include a bathtub, an alcove structure and a shower head facility.

The bathtub is of the type defining a bathing recess and including a rim having a substantially horizontal, planar upper rim surface extending in substantially rectangular framing relation about the opening of the bathing recess, said rim surface having a pair of longitudinally extending sides and a pair of laterally extending sides.

The alcove structure is formed by a pair of parallel, planar end wall structures bracketing the rim surface on its laterally extending sides, and a back wall structure abutting one of the longitudinally extending sides of the rim surface and extending between the end wall structures. Exposed portions of the alcove structure are finished in a waterproof, usually tiled, surface.

The shower head facility is provided on one of said end wall structures, and is adapted to produce a spray directed generally into the bathing recess.

One well-known method for enclosing such combination bathtub/shower structures is to provide a shower curtain assembly including a curtain rod and a shower curtain. The curtain rod is arranged above and parallel to the other of the longitudinally extending sides of said rim surface, opposite to that abutted by the back wall structure, and the shower curtain is suspended from the curtain rod and into the bathing recess, thereby to drape over said other of the longitudinally extending sides of said rim surface.

This method is known to contain most of the spray from said shower head facility. However, the shower curtain tends to leave exposed the corners of the rim surface that are contiguous with the side over which it is draped, so as to create potential leakage paths. Unless the user is extremely careful, shower splash and spray tends to leak past the shower curtain.

A number of devices have been provided in the prior art to ameliorate this leakage problem, which devices typically consist of a screen adapted to be positioned on the rim surface, at the lower corners of the shower curtain. The shower screen described in U.S. Pat. No. 5,222,261 (Tooze et al.), issued Jun. 29, 1993 is exemplary in this regard. These devices are known to limit the amount of shower splash and spray which leaks past the shower curtain. However, they can suffer, inter alia, from poor aesthetics, and relatively high production cost. As well, they can be relatively difficult to install and clean. Moreover, by virtue of their height, they can constitute a safety hazard to persons getting into and out of the bathtub, and, if of the type which are fixedly secured to the tub, can deal a severe blow to any person who falls against it.

SUMMARY OF THE INVENTION

It is an object of the present invention to provide shower curtain leak protection apparatus suitable for use with combination bathtub/shower structures enclosed by shower curtain assemblies that impedes leakage of water past the shower curtain; that is relatively aesthetically pleasing and inexpensive to produce, and relatively easy to install and clean, as compared to devices of similar utility in the prior art; that does not constitute a safety hazard to persons getting into and out of the bathtub; and that is not prone to cause severe injury to persons that fall against it.

This object, amongst others, is met by the present invention, a splash block.

According to one aspect of the invention, the splash block is for use with a combination bathtub/shower structure enclosed by a shower curtain assembly.

The combination bathtub/shower structure is of the type including a bathtub, an alcove structure and a shower head facility.

The bathtub is of the type defining a bathing recess and including a rim having a substantially horizontal, planar upper rim surface extending in substantially rectangular framing relation about the opening of the bathing recess, said rim surface having a pair of longitudinally extending sides and a pair of laterally extending sides.

The alcove structure includes a pair of parallel, planar end wall structures bracketing the rim surface on its laterally extending sides, and a back wall structure abutting one of the longitudinally extending sides of the rim surface and extending between the end wall structures.

The shower head facility extends from one of said end wall structures, and is adapted to produce a spray directed generally into the bathing recess.

The shower curtain assembly includes a curtain rod and a shower curtain.

The curtain rod is arranged above and parallel to the other of the longitudinally extending sides of said rim surface, opposite to that abutted by the back wall structure.

The shower curtain is suspended from the curtain rod and extends into the bathing recess, thereby to drape over said other of the longitudinally extending sides of said rim surface, leaving exposed the corners of said rim surface contiguous therewith.

The splash block comprises a ramp portion and a collar portion, wherein the ramp portion has a drainage surface bounded by a peripheral edge consisting of a drip edge and a collar-receiving edge and wherein the collar portion extends around the collar-receiving edge, and is positionable at an operative position on said rim surface whereat said ramp portion substantially overlies one of said exposed contiguous corners with the drip edge presenting towards the bathing recess, with the drainage surface of said ramp portion presenting upwardly and sloping downwardly to the drip edge, and with the collar portion projecting upwardly.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinafter.

DETAILED DESCRIPTION OF A PREFERRED EMBODIMENT

Figure 1:
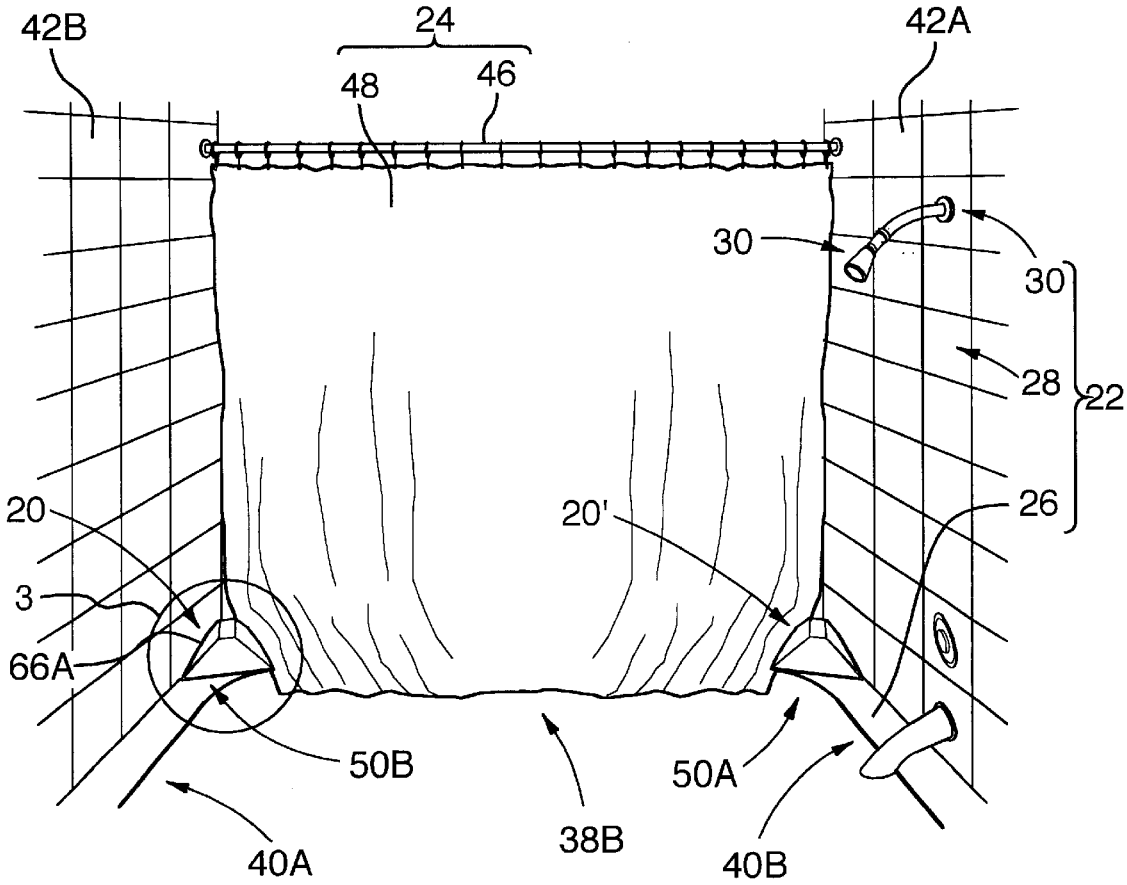
FIG. 1 is a perspective view of a pair of splash blocks according to a preferred embodiment of the present invention in use with a combination bathtub/shower structure enclosed by a shower curtain assembly.

Referring now to FIG. 1 of the drawings, a pair of splash blocks according to a preferred embodiment of the present invention, designated with general reference numeral 20,20' respectively, is shown in use with a combination bathtub/shower structure 22 enclosed by a shower curtain assembly 24.

The combination bathtub/shower structure 22 and shower curtain assembly 24 will firstly be described, for greater clarity in the description of the invention, which follows, but it should be expressly understood that neither the combination bathtub/shower structure 22, nor the shower curtain assembly 24 form part of the invention.

As illustrated in FIG. 1, the combination bathtub/shower structure 22 includes a bathtub 26, an alcove structure 28 and a shower head facility 30.

Figure 2:
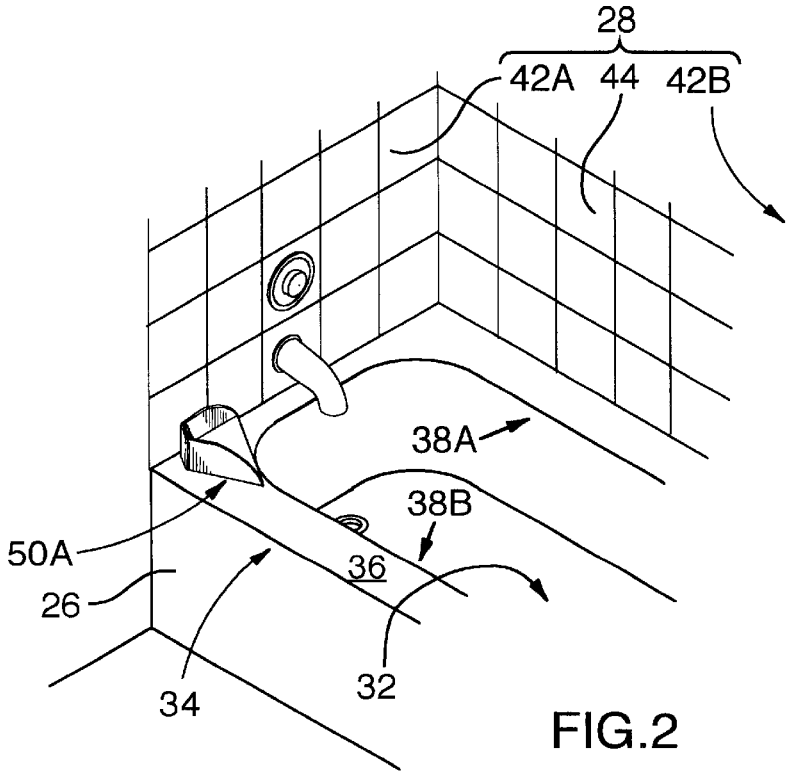
FIG. 2 is a partial perspective view of the structure of FIG. 1, taken from a different perspective, and wherein the shower curtain is removed, for clarity.

As indicated in FIG. 1 and FIG. 2, the bathtub 26 defines a bathing recess 32 and includes a rim 34 having a substantially horizontal, planar upper rim surface 36 extending in substantially rectangular framing relation about the opening of the bathing recess 32, said rim surface 36 having a pair of longitudinally extending sides 38A,38B and a pair of laterally extending sides 40A,40B.

As indicated in FIG. 1 and FIG. 2, the alcove structure 28 includes a pair of parallel, planar end wall structures 42A, 42B bracketing the rim surface 36 on its laterally extending sides 40A,40B, and a back wall structure 44 abutting one of the longitudinally extending sides 38A of rim surface 36 and extending between the end wall structures 42A,42B.

The shower head facility 30 extends from one of said end wall structures 42A, and is adapted to produce a spray (not shown) directed generally into the bathing recess 32.

The shower curtain assembly 24 includes an elongate curtain rod 46 and a shower curtain 48.

The curtain rod 46 is arranged above and parallel to the other of the longitudinally extending sides 38B of said rim surface 36, opposite to the side 38A abutted by the back wall structure 44.

The shower curtain 48 is suspended from curtain rod 46 and extends into the bathing recess 32, thereby to drape over said other of the longitudinally extending sides 38B of said rim surface 36, leaving exposed the corners 50A,50B of said rim surface 36 contiguous therewith.

Turning now to the splash blocks 20,20', each will be seen in FIG. 1 to be preferably substantially identical, and will, upon reading of the following description, will be understood to serve a substantially analogous function. Accordingly, for simplicity, only the structure and operation of the splash block 20 within the encircled area 3 of FIG. 1 will be hereinafter described.

Figure 3:
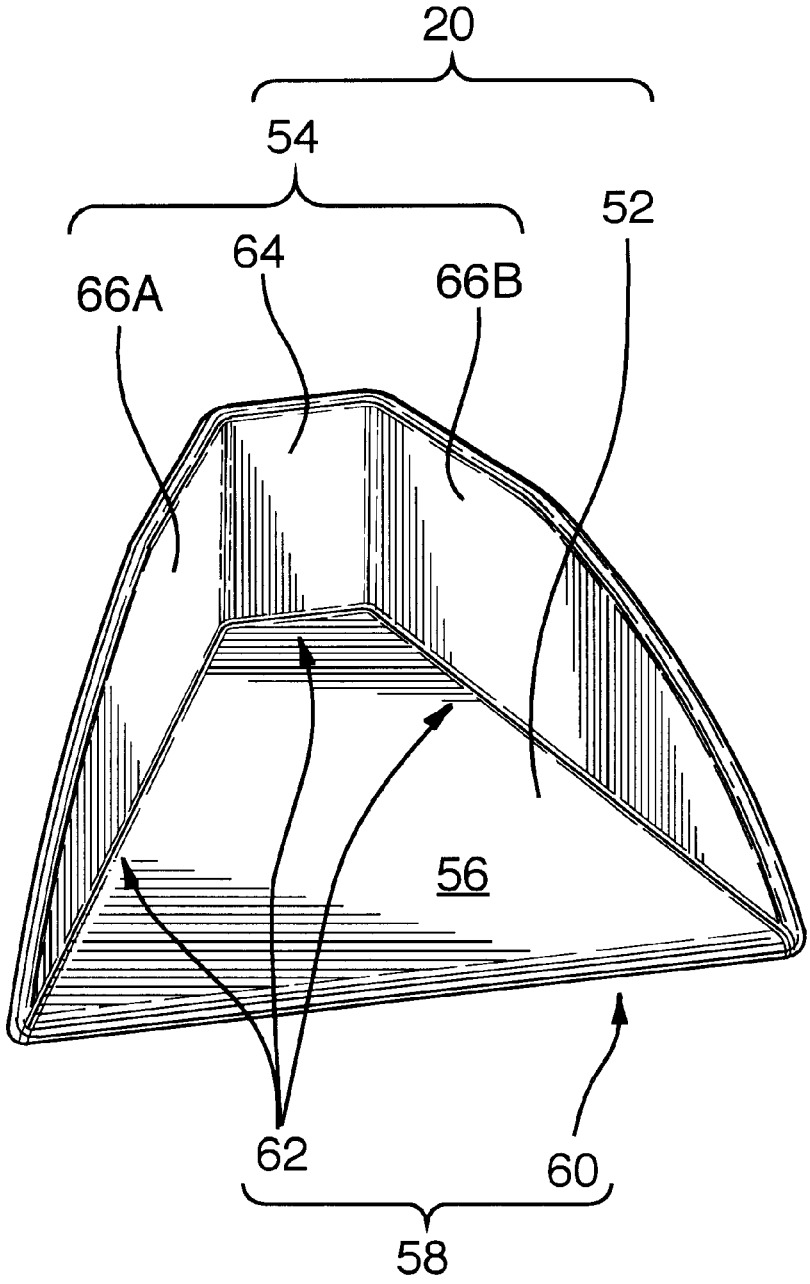
FIG. 3 is an enlarged perspective view of the splash block shown in encircled area 3 of FIG. 1.

Such splash block 20 will be understood to preferably comprise a ramp portion 52 and a collar portion 54, best illustrated in FIG. 3, and to be constructed out of ceramic.

The ramp portion 52 has a substantially planar drainage surface 56 bounded by a peripheral edge 58 consisting of a substantially linear drip edge 60 and a collar-receiving edge 62.

Figure 4:
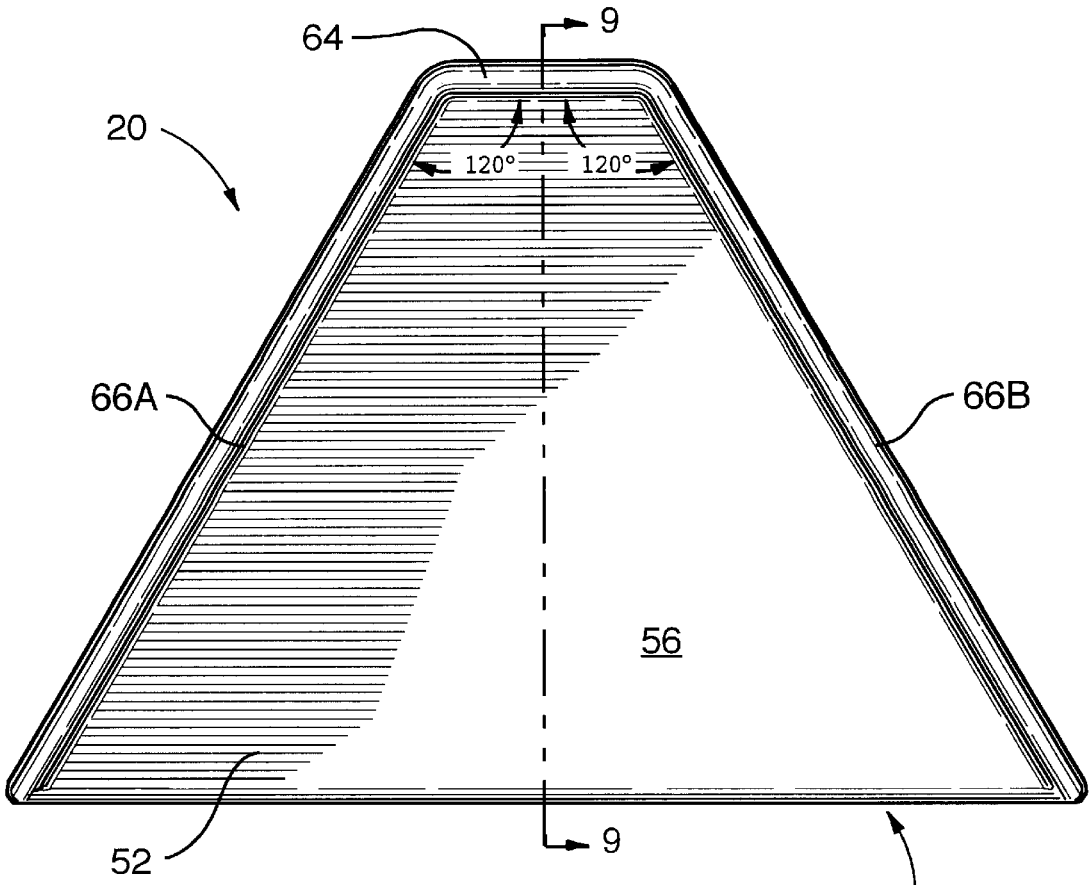
FIG. 4 is a top plan view of the splash block of FIG. 3.
Figure 5:
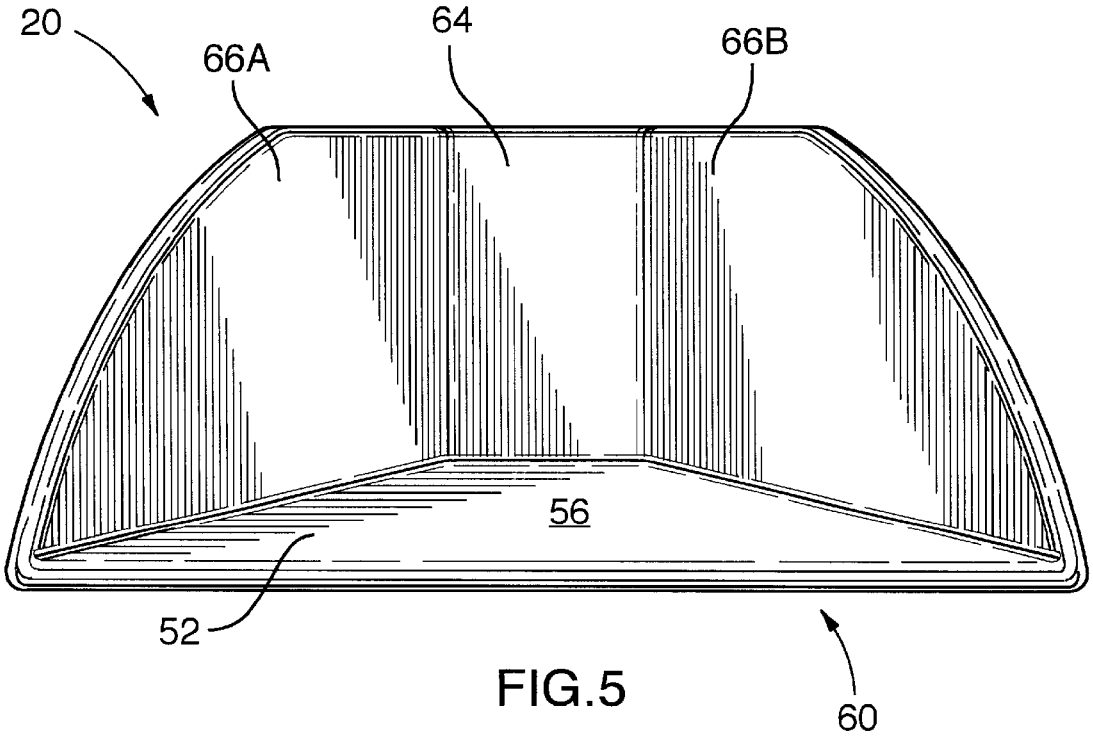
FIG. 5 is a front elevational view of the splash block of FIG. 3.
Figure 6:
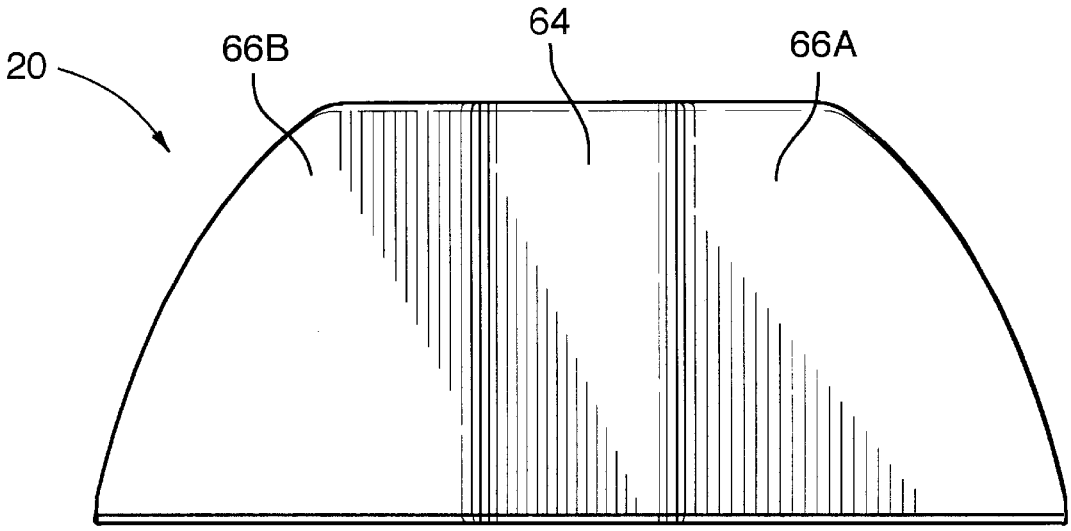
FIG. 6 is a rear elevational view of the splash block of FIG. 3.
Figure 7:
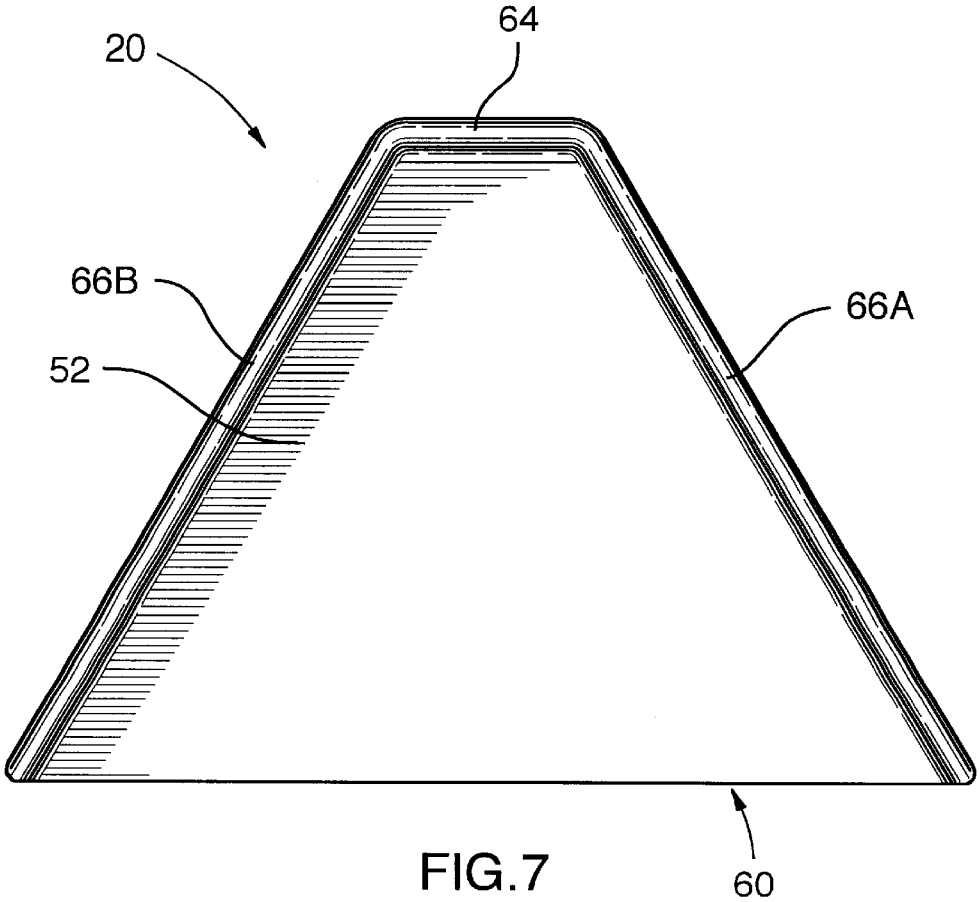
FIG. 7 is a bottom plan view of the splash block of FIG. 3.
Figure 8:
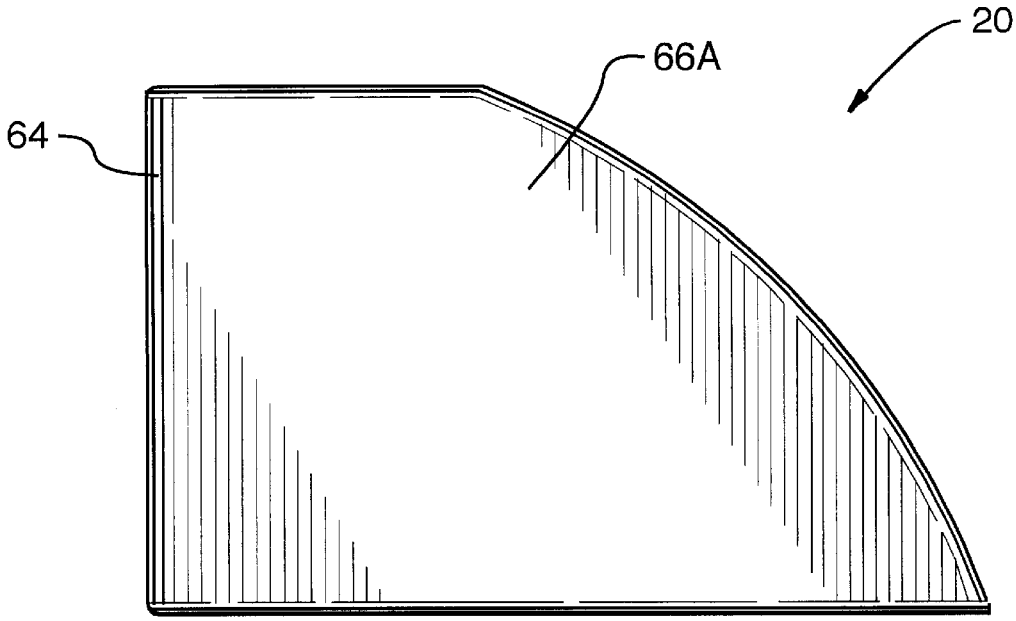
FIG. 8 is a side elevational view of the splash block of FIG. 3.

The collar portion 54 extends around the collar-receiving edge 62 and includes an intermediate section 64 and two side wall sections 66A,66B flanking the intermediate section 64 and extending therefrom to the drip edge 60. Intermediate section 64 is preferably planar, and is arranged substantially parallel with the drip edge 60. The side wall sections 66A,66B are each also preferably substantially planar, taper towards one another as they approach the intermediate section 64 and preferably contain, with the intermediate section 64, an included angle of about 120°, as shown in FIG. 4.

The splash block 20 is positioned at an operative position on said rim surface 36, as illustrated in FIG. 1, and secured in place by suitable adhesive, such as silicon caulking, or grout.

Figure 9:
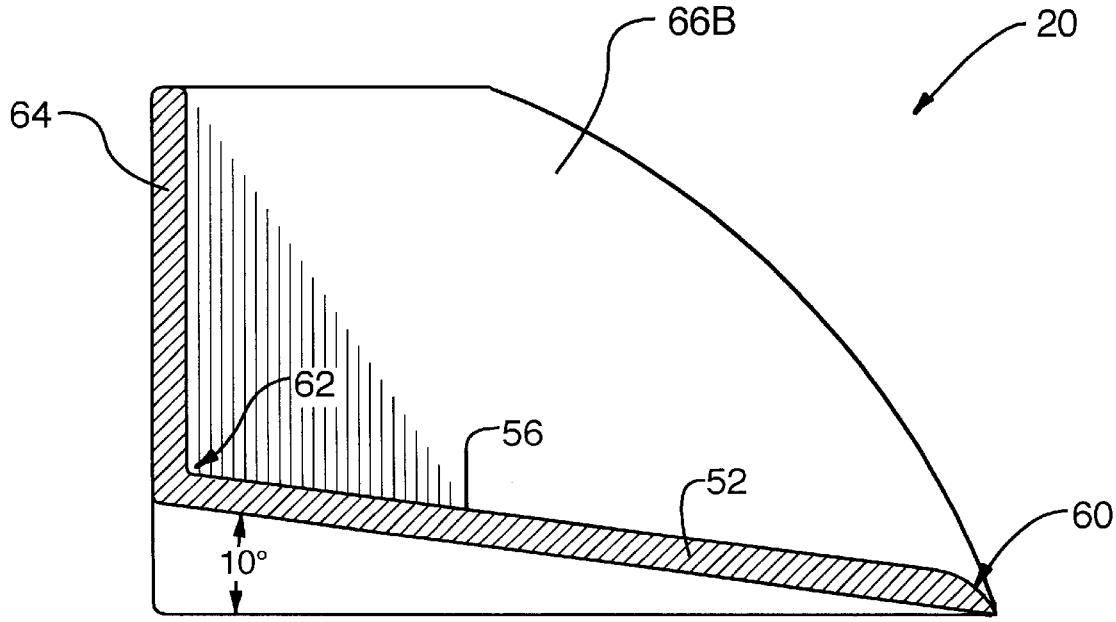
FIG. 9 is a side cross-sectional view of the splash block of FIG. 3, viewed along sight line 9—9 of FIG. 4.

At the operative position of the splash block 20, the ramp portion 52 thereof substantially overlies one of said exposed contiguous corners 50B with the drip edge 60 presenting towards the bathing recess 32, with the drainage surface 56 of said ramp portion 52 presenting upwardly and sloping downwardly to the drip edge 60 at an angle of about 10° to the horizontal, as indicated in FIG. 9, with the collar portion 54 projecting substantially vertically upwardly; and with a respective one of the side wall sections 66A arranged substantially parallel with, and disposed against, the end wall structure 42B adjacent to said one of said exposed contiguous corners 50B.

When so positioned, it will be evident that the splash block 20 does not constitute a safety hazard to persons getting into and out of the bathtub 26, by virtue of the relatively low profile of such splash block 20. Further, even if a person were to fall against it, by virtue of the relatively low profile of collar portion 54, it is not prone to cause severe injury. At the same time, the splash block 20 surprisingly impedes water leakage past the shower curtain 48.

Without intending to be bound by theory, it is believed that the splash block of the present invention functions by synergistic action between the drainage surface 56 and the collar portion 54 thereof, causing shower spray that would otherwise have richocheted off exposed contiguous corner 50B and past shower curtain 48 to be deflected against the collar portion 54, whereupon it drains along the collar portion 54 and the drainage surface 56 into bathing recess 32.

Such functionality is present both when the splash block 20 is disposed at the end of the shower structure 22 opposite the shower head facility 30, as discussed in detail hereinbefore, and also in the context of a splash block disposed at the end of the shower structure 22 proximate the shower head facility 30, as indicated in FIG. 1 by splash block 20'.

It should be understood that, whereas a pair of splash blocks 20,20' is illustrated in FIG. 1, depending upon the showering habits of the person(s) utilizing the shower structure 22, it may be possible to substantially impede leakage through the use of only a single splash block, either as indicated by splash block 20 or by splash block 20', although use of paired splash blocks is preferred, for greater flexibility.

As well, it should be understood that whereas the splash blocks 20,20' of the preferred embodiment illustrated are secured to the tub 26 by conventional adhesive, this need not be the case, and the splash blocks 20,20' could equally be simply rested upon the rim surface 36, although it is preferable in such instances to provide a non-slip surface (not shown) on the underside of the splash blocks 20,20', to avoid same being inadvertently dislodged.

Further, whereas the foregoing disclosure contemplates use of the splash block of the present invention in association with a specific type of combination bathtub/shower structure which has a rim surface that extends in substantially rectangular framing relation about the opening of the bathing recess, it should be emphasized that this need not be the case, and the splash block of the present invention may be utilized with equal utility in association with any type of combination bathtub/shower structure which has a substantially planar, horizontal rim surface extending underneath a shower curtain rod.

Finally, it should also be understood that various modifications and alterations may be used in the design and manufacture of the splash block without departing from the spirit and scope of the invention.

For example, whereas the splash block of the preferred embodiment illustrated is constructed out of ceramic material, it will be understood that other water-resistant materials, such as, for example, plastic or porcelain-coated steel may be utilized with similar utility.

Additionally, whereas the splash block of the preferred embodiment assumes a specific geometric shape, it will be understood that various routine modifications in said shape may be made.

Accordingly, it will be understood that the scope of the present invention is limited only by the accompanying claims, purposively construed.

I claim:

1. A splash block for use with a combination shower/bathtub structure of the type including:

a bathtub of the type defining a bathing recess and including a rim having a substantially horizontal, planar upper rim surface extending in substantially rectangular framing relation about the opening of the bathing recess, said rim surface having a pair of longitudinally extending sides and a pair of laterally extending sides;

an alcove structure including a pair of parallel, planar end wall structures bracketing the rim surface on its laterally extending sides, and a back wall structure abutting one of the longitudinally extending sides of the rim surface and extending between the end wall structures;

a shower head facility extending from one of said end wall structures and which is adapted to produce a spray directed generally into the bathing recess;

a curtain rod arranged above and parallel to the other of the longitudinally extending sides of said rim surface, opposite to that abutted by the back wall structure;

a shower curtain suspended from the curtain rod and extending into the bathing recess, thereby to drape over said other of the longitudinally extending sides of said rim surface, leaving exposed the corners of said rim surface contiguous therewith;

said splash block comprising:

a ramp portion having a drainage surface bounded by a peripheral edge thereof defined by a drip edge and a collar-receiving edge, a portion of the collar receiving edge being disposed opposite the drip edge, when viewed in plan the drainage surface fanning outwardly from the portion of the collar receiving edge toward the drip edge; and a collar portion extending around the collar-receiving edge, said splash block being positionable at an operative position on said rim surface whereat said ramp portion substantially overlies one of said exposed contiguous corners with the drip edge presenting towards the bathing recess, with the drainage surface of said ramp portion presenting upwardly and sloping downwardly to the drip edge, and with the collar portion projecting upwardly.

2. A splash block according to claim 1, wherein the collar portion extends substantially vertically upwardly from the drainage surface when the splash block is operatively positioned.

3. A splash block according to claim 1, wherein the drip edge is substantially linear.

4. A splash block according to claim 1, wherein the drainage surface is planar, and is orientated at an angle of about 10° to the horizontal.

5. A splash block according to claim 1, wherein the collar portion includes and intermediate section and two side wall sections flanking the intermediate section and extending therefrom to the drip edge.

6. A splash block according to claim 5, wherein the intermediate section is planar, and is arranged substantially parallel with the drip edge.

7. A splash block according to claim 5, wherein the side wall sections taper towards one another as they approach the intermediate section.

8. A splash block according to claim 5, wherein the side wall sections are each substantially planar.

9. A splash block according to claim 8, wherein, when said splash block is operatively positioned, a respective one of the side wall sections thereof is arranged substantially parallel with, and disposed against, the end wall structure adjacent to said one of said exposed contiguous corners.

10. A splash block according to claim 8, wherein each side wall section contains, with the intermediate section, an angle of about 120°.

* * * * *